US010524080B1

(12) United States Patent
Johnson et al.

(10) Patent No.: US 10,524,080 B1
(45) Date of Patent: Dec. 31, 2019

(54) SYSTEM TO MOVE A VIRTUAL SOUND AWAY FROM A LISTENER USING A CROSSTALK CANCELER

(71) Applicant: Apple Inc., Cupertino, CA (US)

(72) Inventors: Martin E. Johnson, Los Gatos, CA (US); Darius A. Satongar, Santa Clara, CA (US); Stuart J. Wood, San Francisco, CA (US); Lance F. Reichert, San Francisco, CA (US); Juha O. Merimaa, San Mateo, CA (US); Joshua D. Atkins, Los Angeles, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/111,045

(22) Filed: Aug. 23, 2018

(51) Int. Cl.
*H04S 7/00* (2006.01)
*H04S 1/00* (2006.01)
*G10K 15/08* (2006.01)

(52) U.S. Cl.
CPC ..... *H04S 7/305* (2013.01); *G10K 15/08* (2013.01); *H04S 1/002* (2013.01); *H04S 7/302* (2013.01)

(58) Field of Classification Search
USPC ..... 381/13, 61, 63, 64, 71.1, 71.8, 303
See application file for complete search history.

(56) References Cited

U.S. PATENT DOCUMENTS

2003/0007648 A1* 1/2003 Currell ..... H04S 7/30 381/61
2008/0273708 A1 11/2008 Sandgren et al.
2017/0238119 A1* 8/2017 Schlecht ..... H04S 3/02 381/303

OTHER PUBLICATIONS

Interactive Sound Rendering on Mobile Devices using Ray-Parameterized Reverberation Filters; by Carl Schissler & Dinesh Manocha; Mar. 1, 2018; <https://arxiv.org/pdf/1803.00430>.
3D Audio and Acoustic Environment Modeling, by William G. Gardner, Ph.D. pp. 1-9; Wave Arts, Inc.; Mar. 15, 1999 <https://pdfs.semanticscholar.org/835a/0b28cf9ea881df958cc3648fd68e47a77abc>.
Wwise Help; Wwise RoomVerb; Wwise Pipline; Wwise Properties; pp. 1-3; Apr. 11, 2018; <https://www.audiokinetic.com/library/edge/?source=Help&id=wwise_roomverb_effect_plug_in>.
Virtual Sound using Loudspeakers: Robust acoustic Crosstalk Cancellation, by Darren B Ward, Gary W. Elko; Acoustic Signal Processing for Telecommunication pp. 303-317—2000.

* cited by examiner

*Primary Examiner* — Yosef K Laekemariam
(74) *Attorney, Agent, or Firm* — Womble Bond Dickinson (US) LLP

(57) ABSTRACT

An audio processing system has one or more processors that process an audio signal on three paths. The first path has a direct gain and a direct virtual source algorithm operating on the audio signal. The second path has a plurality of early reflection gains operating on the audio signal. Operation with the early reflection gains produces a plurality of early reflections. Each of the early reflection signals may be subjected to a delay and may be processed according to an early reflections virtual source algorithm. The third path has a reverb gain and binaural reverb filters operating on the audio signal. The third path also has a crosstalk canceler. A mixer combines left and right channel outputs of each of the first path, second path and third path. The mixer produces a left loudspeaker signal and a right loudspeaker signal.

20 Claims, 5 Drawing Sheets

SYSTEM TO MOVE A VIRTUAL SOUND AWAY FROM A LISTENER USING A CROSSTALK CANCELER

An aspect of the disclosure here relates to audio signal processing and virtual acoustic systems. Other aspects are also described.

BACKGROUND

A virtual acoustic system is one that gives the user the illusion that sound is emanating from elsewhere in an indoor or outdoor space than directly from a loudspeaker (e.g., one that is placed in a room, one that is built into a laptop computer, etc. Audio signal processing for virtual acoustics can greatly enhance a movie, a sports even, a videogame or other screen viewing experience, adding to the feeling of "being there". Various known audio processing algorithms, executed by digital processors, modify one or more recorded, synthesized, mixed or otherwise produced digital audio signals in such a way as to position a virtual source according to modeling that is based on human perception of sound, including the role of ear acoustics, other reflecting and absorbing surfaces, distance and angle of source, and other factors. In the case of headphones, specially processed audio signals (binaural rendering) are sent to left and right ears of a listener without the crosstalk that is inevitably received by the ears when listening to stereo loudspeakers. For viewers and listeners that prefer loudspeakers, for example those that may be built into a laptop computer, a crosstalk canceler is employed in some virtual acoustic systems to produce sounds from multiple loudspeakers in such a way that for example a "left" audio signal is predominantly heard only at the left ear of the listener, and a "right" audio signal is predominantly heard only at the right ear of the listener (by virtue of sound wave cancellation in the air surrounding the listener.) This allows the left and right audio signals to contain spatial cues that enable a virtual sound to be "positioned" at a desired location between the loudspeakers.

SUMMARY

An audio processing system with one or more processors that process an audio signal that is split into at least three paths is described. The first path has a direct gain and a direct virtual source algorithm operating on the audio signal. Some versions of the audio processing system have no crosstalk canceling on the first path, while other versions have a first crosstalk canceler on the first path.

The second path has a number of early reflection gains that are applied to the audio signal, which produces multiple early reflections, respectively. In addition, each of these early reflections undergoes a delay, and the early reflections are processed by an early reflections virtual source algorithm. Some versions of the audio processing system have no crosstalk canceling on the second path, while other versions have a second crosstalk canceler on the second path.

The third path has a reverberation gain and binaural reverberation filters operating on the audio signal. The third path has a crosstalk canceler, which may be termed a third crosstalk canceler.

A mixer combines left and right channel outputs of each of the first path, second path and third path. The mixer thus produces a left loudspeaker signal and a right loudspeaker signal.

Another aspect of the disclosure here is a digital processor-based method for processing an audio signal, for example in preparation for playback through a left loudspeaker and a right loudspeaker. The audio signal represents a virtual sound source. The audio signal is split to a first processing path, a second processing path and a third processing path. On the first processing path, the audio signal is operated on, with a direct gain and a direct virtual source algorithm. On the second processing path, the audio signal is operated on with a plurality of early reflection gains, which produces a plurality of early reflections, respectively. Each of the early reflections is subjected to a delay; the early reflections are also processed by an early reflections virtual source algorithm. On the third processing path, the audio signal is operated on, with a reverb gain and binaural reverb filters, and crosstalk canceling. The left and right channel outputs of each of the first, second and third processing paths are combined, to produce a left loudspeaker signal and a right loudspeaker signal.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description.

In the description, certain terminology is used to describe features of the invention. For example, in certain situations, the terms "component," "unit," "module," and "logic" are representative of computer hardware and/or software configured to perform one or more functions. For instance, examples of "hardware" include, but are not limited to an integrated circuit such as a processor (e.g., a digital signal processor, microprocessor, application specific integrated circuit, a micro-controller, etc.) Of course, the hardware may be alternatively implemented as a finite state machine or even combinatorial logic. An example of "software" includes processor executable code in the form of an application, an applet, a routine, a module or a series of instructions. The software may be stored in any type of machine-readable medium and when executed by a processor performs various digital signal processing operations upon an audio signal to produce left and right loudspeaker signals, as described below.

Figure 1:
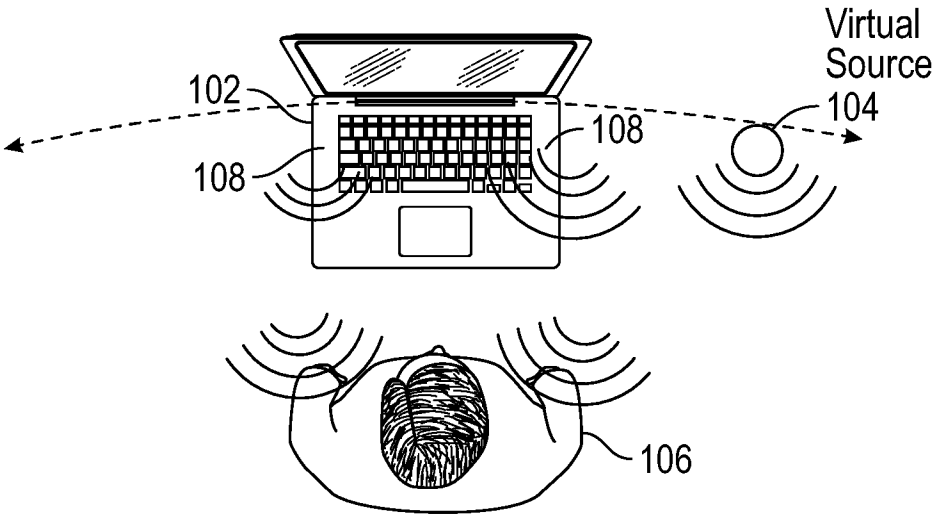
FIG. 1 depicts a crosstalk canceler, in a laptop computer 102, processing an audio signal to move a virtual source of sound to one side of the loudspeaker of the laptop computer, as perceived by a listener.

One common form of virtual acoustic system uses a pair of loudspeakers that may be built into a device, such as a laptop computer, and where a crosstalk canceler moves sound sources to the side of the device. FIG. 1 depicts such a crosstalk canceler, in a laptop computer 102, processing an audio signal to move a virtual source 104 of sound to one side of loudspeakers 108 of the laptop computer 102, so that the audio content in the audio signal is perceived by a listener 106 as a sound that is originating from off to the side rather than from the location of the loudspeakers 108.

It will be assumed for the purposes of this disclosure that a crosstalk canceler algorithm exists or can readily be developed and hence used in various aspects of this disclosure. For example, a crosstalk canceler for audio signal processing can be implemented using digital filters in a digital signal processing algorithm. A crosstalk canceler may add a cancellation signal to the left channel of audio, and another cancellation signal to the right channel of audio, so that a listener 106 who is positioned in a "sweet spot" relative to left and right loudspeakers receives sound at her left and right ears with any crosstalk from the loudspeaker being canceled, as if the listener 106 is using headphones. The cancellation signal added to the left channel of audio takes into account sound arriving at the left ear from the right loudspeaker, and the cancellation signal added to the right channel of audio takes into account sound arriving at the right ear from the left loudspeaker (i.e., crosstalk). Simpler crosstalk canceler algorithms are based on acoustic delay paths from loudspeaker to ear, and more complex crosstalk canceler algorithms may be further based on room acoustics and ear acoustics. Crosstalk cancellation, in various versions, can be performed in real-time and inserted into an audio signal path, when playing back recorded sound or performed for live or real-time generated sound; it could also be performed in preprocessing prior to recording sound (for later playback through loudspeaker) so that the crosstalk cancellation is effectively in place from the preprocessing.

Figure 2:
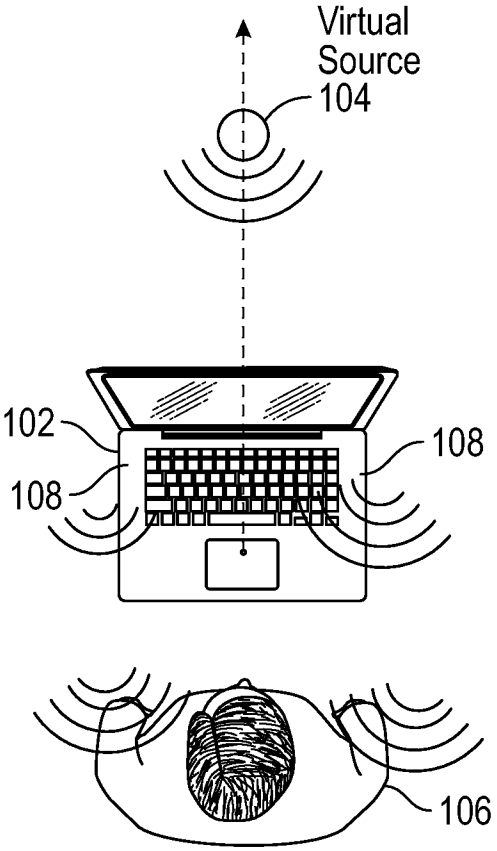
FIG. 2 depicts a different use of a crosstalk canceler, in an aspect of the present disclosure that is processing an audio signal to move a virtual source farther away from, and behind, the loudspeaker of a laptop computer, as perceived by a listener.

FIG. 2 depicts a different use of a crosstalk canceler, in one aspect of the present disclosure. Here, the crosstalk canceller is processing an audio signal to move the virtual source 104 farther away from, and behind, the loudspeakers 108 of the laptop computer 102, as perceived by the listener 106. In other words, the virtual sound source 104 is moved away from the device such that it appears (to the listener) to come from farther away than the physical device that is actually producing the sound, in this example the loudspeakers 108 in the laptop computer 102. In other words, the sound source has moved from the foreground away into the background. The following may be one explanation for this result.

Figure 3:
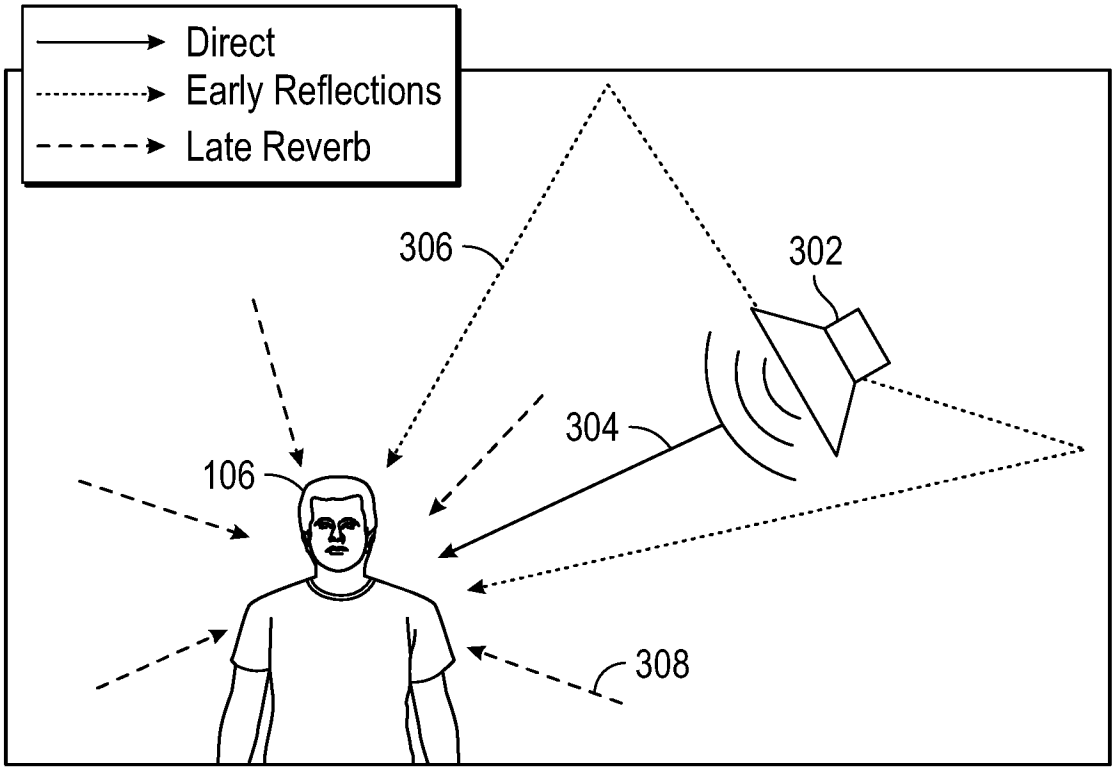
FIG. 3 depicts three components of sound reaching a listener from a sound source, in this example a loudspeaker, the three components being direct sound, early reflections and reverberation (late reverb.)

FIG. 3 depicts three components of sound from a sound source 302 in a room, in this case a loudspeaker, reaching the listener 106, the three components being direct sound 304, early reflections 306 and late reverb or reverberation 308. The direct sound 304 is sound that comes directly from the source to the listener. Early reflections 306 are sounds that arrive at the listener a short time after the direct sound 304 (e.g., within 10 or 15 msec) and come from angles relatively close to the direct sound 304. Late reverberation 308 contains reflections that arrive later, e.g., >15 ms after the direct sound 304 and arrive from a wide variety of angles. From aspects of these components of sound reaching the ears of the listener, the listener perceives the distance to the sound source 302. Audio processing systems may manipulate an audio signal to produce illusion of position, distance and motion of a virtual sound source, as if the sound source 302 is actually present at that position. Distance perception in a room, for a listener 106 and a sound source 302, may be based on various factors, as discussed below.

As the source 302 is moved farther from the listener 106, the sound pressure level of the direct sound 304 is inversely proportional to distance from the sound source 302 to the listener 106, i.e. the farther away the lower the sound level. However, the level of the early reflections 306 and the reverberation 308 do not change as much, with the position and distance of the source. Therefore one of the key cues that may be used to determine the distance of the source 302 to the listener 106 in a room is the ratio of the direct sound 304 to the reflected and/or reverberant sound (direct to reverberant ratio). So, as the direct to reverberant ratio gets smaller the source is perceived to be farther away. It is important to emphasize that adding reverberation to a signal by itself may give some sense of distance but it is really the spatial nature of the reverberation that adds the perception of depth (where the reverberant energy arrives at the listener from many directions, not just from a few).

With the above understanding of how sound is perceived, an example of how a virtual acoustic system can move sound directly backward is provided in FIG. 2. Typically when using a device such as a laptop computer 102, a tablet or a smartphone, the listener 106 is close to the loudspeakers that are integrated within a housing of the device (e.g., <0.5 meter away), and this means that the direct to reverberant ratio is large and most of the sound power arrives at the listener 106 directly from the loudspeakers. To give the impression that the sound is coming from behind the device (i.e. farther away) a crosstalk canceler is used as further described below, to generate artificial early reflections that arrive at the listener 106 from angles off of the main screen but consistent with a virtual sound source 104 that is behind the device.

Figure 4:
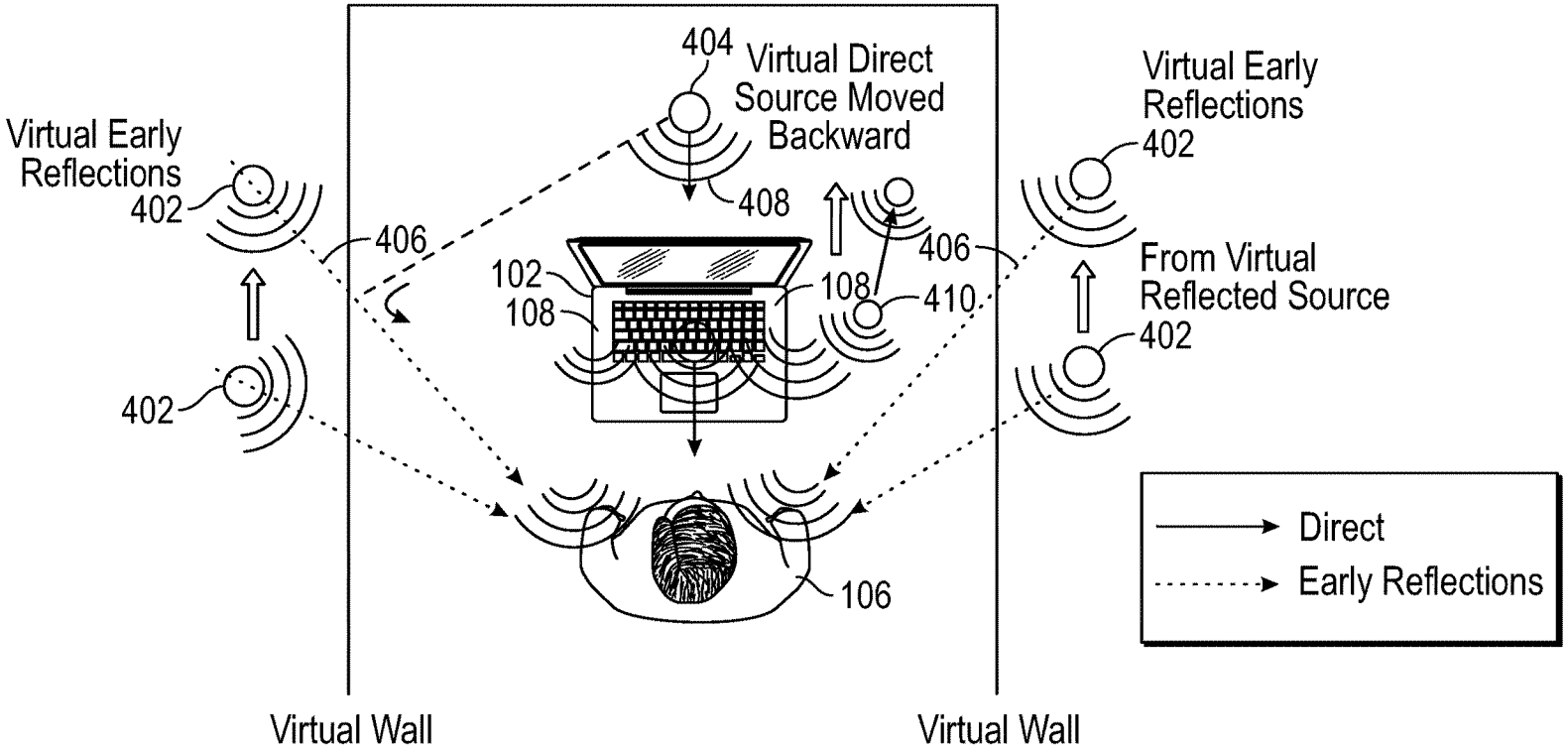
FIG. 4 depicts a virtual direct source moved backwards, relative to the loudspeakers of a laptop computer and the listener, and virtual early reflections of sound.

FIG. 4 depicts an example of how a virtual direct source 404 is moved backwards, relative to the loudspeakers 108 of a laptop computer 102 and the listener 106. It also shows how virtual early reflections 406 (from virtual reflected sources 402) and the virtual direct sound 408 (from the virtual direct source 404) change as the virtual direct source 404 moves from foreground to background. As the virtual direct source 404 moves farther away and backward from a foreground position that is directly above the laptop computer 102, the virtual direct sound 408 reduces in amplitude rapidly but the sound level from the virtual early reflections 406 does not. This illusion of motion of the virtual direct source 404 can be generated by turning down the direct source (i.e., decreasing level of direct sound to the listener 106) while adding in the reflected sources (i.e., increasing level of reflected sound to the listener 106). The sound from virtual reflected sources, as received by the listener 106, needs to be delayed so that they arrive after the direct sound, as the reflected sounds would with real reflections (and associated longer paths). This delay maintains the precedence effect, in which the human brain uses the first arriving, direct sound from a sound source to determine direction (e.g., in FIG. 4, sound of the virtual direct source 404 is from directly in front of the listener 106).

Figure 5A:
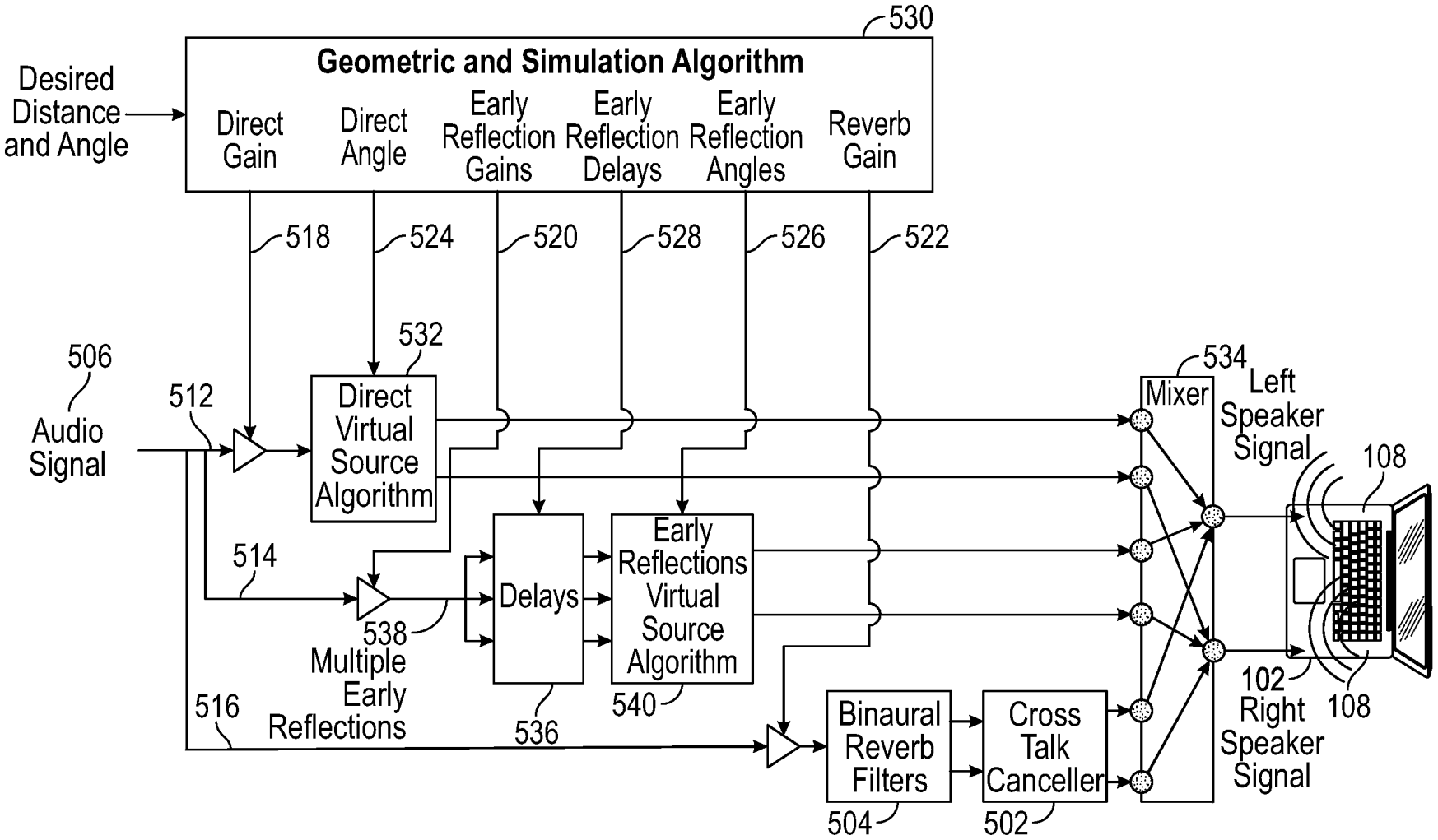
FIG. 5A is a block diagram of an audio processing system, in which a crosstalk canceler operates on the output of binaural reverb filters operating on an audio signal.

In addition to the virtual early reflections 406, the reverberation component of the sound field in FIG. 4 can be maintained, by using a crosstalk canceler as shown in FIG. 5A to directly create binaural reverberation at the ears of the listener 106. The effect is as if the sound of the virtual early reflections 406 were delivered directly to the ears of the listener by headphones, without crosstalk from the loudspeakers 108. Note that in the version of FIG. 5A, there is a cross talk canceller 502 in the path 516, but none in the paths 512, 514. In another version, there is a cross talk canceller in each of the three paths—see FIG. 5B where the virtual direct sound from a virtual direct source 404 may be processed with crosstalk canceling, while the virtual reflected sound of the virtual early reflections sources is also processed with crosstalk canceling, as is the sound from virtual reverberation. Each of these crosstalk cancelers may be tuned independently of the others, or they may be coordinated together, in variations of the audio processing system of FIG. 5B. The positions of the crosstalk cancelers in their respective paths, upstream of the mixer, may be different than shown. Positioning of each cross talk canceler in a respective path, upstream of the mixer, allows crosstalk cancellation to be performed for each path that is independent of crosstalk cancellation in another path.

More generally, and in further versions, crosstalk cancelers can use more than two speakers, and the speakers can be in arrangements other than a strict left-right arrangement. Also, virtual audio rendering using speakers may be viewed as a two stage process, (i) binaural filters for the source ("virtual source algorithm") and then (ii) a cross talk canceller to deliver the binaural signals faithfully to the two ears of a listener without crosstalk. In some versions these two operations are designed together. One exception to this is when there are sources directly behind the laptop (e.g., a virtual direct source 404), where the "direct virtual source algorithm" is a pass through or panning algorithm without the need of a cross talk canceller because there is a real source in the correct position. However, in this case many of the early reflections (e.g., virtual reflected sources 402) would not come from the direction of the device (e.g., laptop computer 102) and would need to be rendered using the cross talk canceller (this may be viewed as a variation to FIG. 5A, by adding a cross talk canceller to the output of the early reflections virtual source algorithm.) These and further variations are readily devised in further variations of the aspects depicted in FIGS. 5A and 5B.

FIG. 5A is a block diagram of an audio processing system in which a crosstalk canceler 502 operates on the output of binaural reverb filters 504 that in turn are operating on an audio signal 506. This figure and in particular the labeled elements therein may also be used to illustrate the operations of a processor-based of audio signal processing. The audio processing system operates by splitting the audio signal of a virtual source into paths 512, 514, 516 for the three components of virtual sound, analogous to the three components of sound discussed with reference to FIG. 3. The gains 518, 520, 522, and angles 524, 526 and delays 528 will be varied appropriately, e.g., by a geometric and simulation algorithm 530, as a function of or in response to the desired distance between the listener 106 (listener position) and a position of the virtual source 104 being increased or decreased, or as a function of or in response to the desired position of the virtual source relative to the listener position being changed.

In the first path 512 in the audio processing system, a direct gain 518 operates on the audio signal. For example, this can be implemented through multiplication, or a multiplier, with the direct gain as a parameter for multiplication of the data of the audio signal. A direct virtual source algorithm 532 operates on the direct gain adjusted audio signal, or in some versions is combined and performs the direct gain operation with angular positioning adjustment of the virtual source, to produce left and right channel audio signals for input to the mixer 534. For example, if it is desired to move the virtual source to the right, the geometric and simulation algorithm 530 could configures the direct gain 518 and the angles 524 so that the left channel exhibits a version of the audio signal 506 that has decreased volume and increased delay, in comparison to the right channel, and vice versa for moving the virtual source to the left. Moving the virtual source backward, away from the listener, could result in both channels having decreased volume. In this version shown in FIG. 5A, there is no crosstalk canceling and therefore no crosstalk canceler on the first path 512. The first path 512 produces audio signal data of sound for the direct virtual source, from the audio signal 506, for the virtual source 404.

In the second path 514 in the audio processing system, early reflection gains 520 operate on the audio signal, which is split into audio data for multiple early reflections 538 (each of which may have a different early reflection gain 520 applied to it.) Early reflection delays 528 operate on the multiple early reflections 538, with each early reflection having a delay and processing according to an early reflections virtual source algorithm 540. For this function, a delays module 536 could implement multiple delay lines with taps, or other algorithmic processes for delays could be used. The early reflections virtual source algorithm 540 may adjust angles for virtual sources and virtual walls or other virtual objects for reflections, absorption and reflection parameters that may be audio frequency dependent, etc., to produce left and right channel audio signals for the mixer 534. In this version, there is no crosstalk canceling and therefore no crosstalk canceler on the second path 514 for the audio signal. The second path 514 produces audio signal data of sound for the multiple early reflections 538 from the audio signal 506 for the virtual source.

In the third path 516 in the audio processing system, a reverb gain 522 and binaural reverb filters 504 operate on the audio signal 506. These produce the late reflections, reverberation sound that arrives at the listener from many directions as depicted in FIG. 3, for a virtual audio source, against which the audio perception of the listener compares the virtual direct audio sound, so as to perceive distance to the virtual source. Output of the binaural reverb filters 504 is left and right channel audio data, which is input into a crosstalk canceler 502. With crosstalk cancellation, the reverberation sound data has added signaling in each of the channels to cancel out crosstalk from the loudspeakers, so that the reverb sound arrives at the ears of the listener as if delivered through headphones, without crosstalk. This may make for a better delivery of the reverberation sound, to the listener, so that the listener can better perceive depth cues from the ratio of the virtual direct sound to the reverberation sound, for enhanced sound depth perception.

The mixer 534 combines left and right channel outputs of the first path 512, second path 514 and third path 516, to produce a left loudspeaker signal and a right loudspeaker signal. Mixing, in FIG. 5A, is shown in two stages, but could be combined in a single stage in a further version. Also, the audio processing system version shown in FIG. 5A is shown for a single audio signal, representing a virtual audio source, but could readily be implemented for multiple audio signals and multiple virtual audio sources, with appropriate versions of the paths 512, 514, 516, the geometric and simulation algorithm 530, and the mixer 534.

While a listener is listening to the system (e.g., listening to a number of loudspeakers, or to the built-in loudspeakers of a laptop computer) in a real room, there will be reverberation due to the actual loudspeakers in the room (i.e. independent of the virtual room). Therefore if the desired placement of the virtual sound source is on the device, the reverberation gain 522 and early reflection gains 520 are turned to zero, or at least lower. It is only when the virtual sound source is moved farther away are the gains 520, 522 of the early reflections and reverberation turned up. It is also possible to use this method to move a virtual sound source 410 that is already virtually placed off of the device at a given angle farther away (see FIG. 4).

It should be noted that with any virtual acoustic simulation using loudspeakers there is always some imperfection or error that typically draws the listener's perception of the source location back towards the physical device. For this reason the strength and directions of the early reflections and the reverberation levels may need to be exaggerated (e.g., early reflection gains and reverb gain in comparison to direct gain) in order to create a compelling perception of depth and this will be reflected in the choices made in the geometric and simulation algorithm 530 shown in FIGS. 5A and 5B.

Figure 5B:
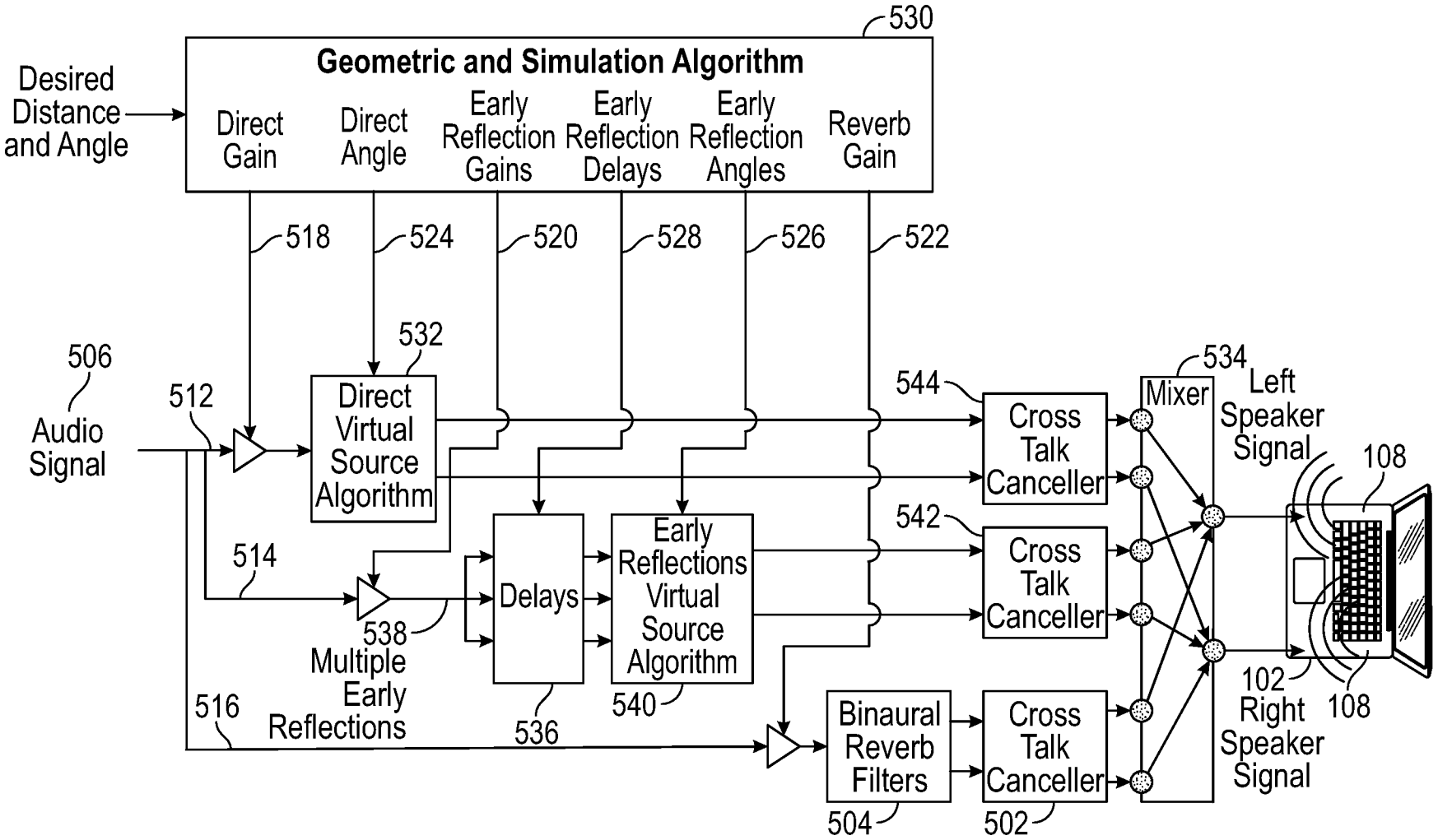
FIG. 5B is a block diagram of an audio processing system, in which crosstalk cancelers operate on outputs of a direct virtual source algorithm operating on an audio signal, an early reflections virtual source algorithm operating on the audio signal, and binaural reverb filters operating on the audio signal, as a variation of the audio processing system in FIG. 5A.

FIG. 5B is a block diagram of an audio processing system, in which crosstalk cancelers 544, 542, 502 operate on outputs of a direct virtual source algorithm 532 that is operating on a digital audio signal 506, an early reflections virtual source algorithm 540 operating on the audio signal 506, and binaural reverb filters 504 operating on the audio signal 506, as a variation of the audio processing system in FIG. 5A. As in the version of FIG. 5A, the algorithms, cross talk cancellers, gain blocks, delay blocks, and the reverb filters of FIG. 5B could also be implemented as one or more programmed digital signal processors (or generically referred to here as "a processor), with or without dedicated hardwired circuitry (as needed for the particular application.) The audio processing system operates by splitting the audio signal of a virtual source into paths 512, 514, 516 for the three components of virtual sound, similarly to the version in FIG. 5A, and varying the gains 518, 520, 522, angles 524, 526 and delays 528 appropriately as the distance from a listener position to a position of the virtual source is increased or decreased or the position of the virtual source relative to the listener position is changed.

On the first path 512 in the audio processing system of FIG. 5B, a direct gain 518 operates on the audio signal. For example, this can be implemented through multiplication, or a multiplier, with the direct gain as a parameter for multiplication of the data of the audio signal. A direct virtual source algorithm 532 operates on the direct gain adjusted audio signal, or in some versions is combined and performs the direct gain operation with angular positioning adjustment of the virtual source, to produce left and right channel audio signals for the mixer 534. In this version, there is crosstalk canceling using a crosstalk canceler 544 on the first path 512 for the audio signal. The first path 512 produces audio signal data of sound for the direct virtual source from the audio signal 506 for the virtual source.

On the second path 514 in the audio processing system, early reflection gains 520 operate on the audio signal, which is split into audio data for multiple early reflections 538. Early reflection delays 528 operate on the multiple early reflections 538, with each early reflection having a delay and processing according to an early reflections virtual source algorithm 540. For this function, a delays module 536 could implement multiple delay lines with taps, or other algorithmic processes for delays could be used. The early reflections virtual source algorithm 540 may adjust angles for virtual sources and virtual walls or other virtual objects for reflections, absorption and reflection parameters that may be audio frequency dependent, etc., to produce left and right channel audio signals for the mixer 534. In this version, there is crosstalk canceling using a crosstalk canceler 542 on the second path 514. The second path 514 produces audio signal data of sound for the multiple early reflections 538 from the audio signal 506 for the virtual source.

On the third path 516 in the audio processing system, a reverb gain 522 and binaural reverb filters 504 operate on the audio signal 506. These produce the later, reverberation sound from many directions as depicted in FIG. 3, for a virtual audio source, against which the audio perception of the listener compares the virtual direct audio sound to perceive distance to the virtual source. Output of the binaural reverb filters 504 is left and right channel audio data, which is input into a crosstalk canceler 502. With crosstalk cancellation, the reverberation sound data has added signaling in each of the channels to cancel out crosstalk from the loudspeakers, so that the reverb sound arrives at the ears of the listener as if delivered through headphones, without crosstalk. This may make for a better delivery of the reverberation sound, to the listener, so that the listener can better perceive depth cues from the ratio of the virtual direct sound to the reverberation sound, for enhanced sound depth perception.

The mixer 534 combines left and right channel outputs of the first path 512, second path 514 and third path 516, to produce a left loudspeaker signal and a right loudspeaker signal. Mixing, in FIG. 5B is shown in two stages, but could be combined in a single stage in a further version. As in the version in FIG. 5A, the audio processing system version shown in FIG. 5B is shown for a single audio signal, representing a virtual audio source, but could readily be implemented for multiple audio signals and multiple virtual audio sources, with appropriate versions of the paths 512, 514, 516, the geometric and simulation algorithm 530, and the mixer 534. Further variations, for example with a crosstalk canceler on each of the first path 512 and third path 516, the second path 514 and third path 516, or first path 512 and second path 514, are readily devised.

With reference to FIGS. 5A and 5B, any or all of the crosstalk cancelers 544, 542, 502 could be responsive to an angle of a virtual source, to adjust signals for left and right channels of a path 512, 514, 516 as the angle of the virtual source relative to the listener changes. Crosstalk cancelers for different processing paths could be responsive to different angles, e.g., angle of the virtual source, angles of virtual reflections. For example the crosstalk canceler 502 on the third path 516 could be responsive to the angle of the virtual audio source relative to virtual walls and virtual objects for multiple reflections, and angles of virtual reflections relative to the listener. The crosstalk canceler 544 on the first path 512 could be responsive to the angle of the virtual audio source relative to the listener for direct virtual sound, and the crosstalk canceler 542 on the second path 514 could be responsive to the angle of the virtual audio source relative to virtual walls, ground or floor and ceiling, and angles of virtual reflections relative to the listener, for the multiple early reflections 538.

Some versions of the binaural reverb filters 504 make use of head-related transfer functions (HRTF) for the reverberated sound, with time delay, amplitude and tonal transformation of sound based on models or measurements of human ears and the human head. The crosstalk canceler 502 on the third path 516 may be especially effective with such modeling, in delivering reverb sound of a virtual audio source from loudspeakers to ears of a listener as if through headphones without loudspeaker crosstalk. Head-related transfer functions may be used in one or more of the crosstalk cancelers 544, 542, 502, in variations.

The aspects of this disclosure described above, including the geometric and simulation algorithm, the direct virtual source algorithm, the early reflections virtual source algorithm, the binaural reverb filters, the cross talk cancellers, and the mixing or combining, may all be implemented as one or more digital processors (generically referred to here as "a processor") that is executing computer program instructions that are stored in solid state memory of an electronic audio system. As one example, this processor memory may be part of the laptop computer 102 mentioned above.

In one aspect, the laptop computer 102 has a left loudspeaker and a right loudspeaker built into the horizontal part of the laptop housing on either side the of physical keyboard as shown. More generally however, the virtual sound source techniques described above could also be applied to a system that has more than two loudspeakers that can be used to position the virtual direct source and the virtual direct early reflections.

While certain aspects have been described and shown in the accompanying drawings, it is to be understood that such are merely illustrative of and not restrictive on the broad invention, and that the invention is not limited to the specific constructions and arrangements shown and described, since various other modifications may occur to those of ordinary skill in the art. For example, while FIG. 4 depicts the audio system as being a laptop computer, it is also possible to implement the operations described above in a desktop computer or in a television set that has built in left and right loudspeakers (somewhat similarly arranged as in the laptop computer 102.) Also, while the figures show that certain operations or processes are performed sequentially on the audio signal in a given path, some of those operations for example linear operations could be performed in a different order than shown, e.g., the order in which the early reflection gains 520 and the early reflection delays 528 are applied could be reversed. The description is thus to be regarded as illustrative instead of limiting.

What is claimed is:

1. An audio processing system, comprising:

a processor configured to process an audio signal on three paths, comprising:

a first path having a direct gain and a direct virtual source algorithm that are to operate on the audio signal;

a second path having i) a plurality of early reflection gains that are to operate on the audio signal to produce a plurality of early reflection signals, respectively, and a respective delay that is to operate on each of the early reflection signals, and ii) an early reflections virtual source algorithm that is to operate on the plurality of early reflection signals; and a third path having i) a reverb gain and binaural reverb filters that are to operate on the audio signal, and ii) a third crosstalk canceler; and a mixer to combine left and right channel outputs of each of the first path, the second path and the third path to produce a left loudspeaker signal and a right loudspeaker signal.

2. The audio processing system of claim 1, wherein the first path has no crosstalk canceler and the second path has no crosstalk canceler.

3. The audio processing system of claim 1, wherein the third crosstalk canceler is responsive to an angle for a virtual source of the audio signal.

4. The audio processing system of claim 1, wherein the third crosstalk canceler is to modify left and right channel outputs of the binaural reverb filters to drive left and right loudspeakers to produce sounds that are received by ears of a listener as if through headphones.

5. The audio processing system of claim 1, further comprising:

a geometric and simulation module, executing on the processor, to decrease the direct gain and increase the early reflection gains and the reverb gain, to simulate a virtual sound moving away from a listener.

6. The audio processing system of claim 1, wherein the left loudspeaker signal and the right loudspeaker signal are to be produced by the mixer to drive a plurality of loudspeakers that are integrated in a laptop computer.

7. The audio processing system of claim 1, wherein the binaural reverb filters are to modify the audio signal to produce reverberation as if arriving at ears of a listener.

8. The audio processing system of claim 1, wherein the first path has a first crosstalk canceler and the second path has a second crosstalk canceler, and wherein the first and second crosstalk cancelers are responsive to different angles.

9. The audio processing system of claim 1, wherein the early reflection gains and the reverb gain are greater in comparison to the direct gain.

10. The audio processing system of claim 1, wherein the binaural reverb filters use head-related transfer functions.

11. A processor-based method of audio processing, comprising:

splitting an audio signal, representing a virtual sound source, to a first processing path, a second processing path and a third processing path;

in the first processing path, operating with a direct gain and a direct virtual source algorithm on the audio signal in the first processing path;

in the second processing path, operating with a plurality of early reflection gains on the audio signal in the second processing path and producing a plurality of early reflections respectively, each having an adjustable delay, and processing the plurality of early reflections according to an early reflections virtual source algorithm;

in the third processing path, operating with a reverb gain and binaural reverb filters on the audio signal in the third processing path, and crosstalk canceling upon outputs of the binaural reverb filters; and combining left and right channel outputs of each of the first, second and third processing paths, to produce a left loudspeaker signal and a right loudspeaker signal.

12. The method of claim 11, further comprising:

processing further audio signals on further paths; and further combining, in the mixer, left and right channel outputs of the further paths.

13. The method of claim 11, further comprising:

determining the crosstalk canceling on the third processing path based on an angle for a virtual source of the audio signal.

14. The method of claim 11, wherein the crosstalk canceling on the third processing path comprises modifying left and right channel outputs of the binaural reverb filters to drive left and right loudspeakers to produce sounds that are received by ears of a listener as if through headphones.

15. The method of claim 11, further comprising:

decreasing the direct gain and increasing the early reflection gains and the reverb gain to simulate a virtual sound moving away from a listener.

16. The method of claim 11, wherein combining to produce the left loudspeaker signal and the right loudspeaker signal comprises producing the left loudspeaker signal and the right loudspeaker signal to drive a plurality of loudspeakers that are integrated into a laptop computer.

17. The method of claim 11, wherein the operating with the binaural reverb filters comprises modifying the audio signal to produce reverberation as if arriving at ears of a listener.

18. The method of claim 11, further comprising:

operating with crosstalk canceling on the first processing path, responsive to a first angle of the virtual sound source;

operating with crosstalk canceling on the second processing path, responsive to a second plurality of angles of the early reflections; and operating with the crosstalk canceling on the third processing path, responsive to a third angle.

19. The method of claim 11, further comprising increasing the early reflection gains and the reverb gain in comparison to the direct gain.

20. The method of claim 11, wherein the operating with the binaural reverb filters uses head-related transfer functions.

* * * * *